US006374065B1

(12) United States Patent
Nishimura et al.

(10) Patent No.: US 6,374,065 B1
(45) Date of Patent: Apr. 16, 2002

(54) SPEED RATIO BETWEEN AN IMAGE HOLDING MEMBER AND A DEVELOPER CARRIER VARIES ACCORDING TO AN IMAGE RATIO

(75) Inventors: Katsuhiko Nishimura, Yokohama; Tatsuya Kobayashi, Shizuoka-ken; Naoki Enomoto, Mishima; Takashi Shibuya, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/653,003

(22) Filed: Aug. 31, 2000

(30) Foreign Application Priority Data

Sep. 6, 1999 (JP) ..... 11-251808
Oct. 28, 1999 (JP) ..... 11-307603

(51) Int. Cl.[7] ..... G03G 15/00; G03G 15/08

(52) U.S. Cl. ..... 399/53; 399/9; 399/236; 358/462

(58) Field of Search ..... 399/236, 53, 9, 399/38, 46, 222, 252, 279; 358/1.5, 462, 296

(56) References Cited

U.S. PATENT DOCUMENTS

| | | | | |
|---|---|---|---|---|
| 3,866,574 A | | 2/1975 | Hardennrook et al | 399/285 |
| 4,774,543 A | | 9/1988 | Yoshikawa et al | 399/231 |
| 5,177,537 A | | 1/1993 | Okano et al. | 399/222 |
| 5,369,478 A | | 11/1994 | Kobayashi et al. | 399/236 |
| 5,519,471 A | | 5/1996 | Nishimura et al. | 399/284 |
| 5,521,683 A | | 5/1996 | Miyamoto et al | 399/55 |
| 5,666,588 A | | 9/1997 | Uchiyama et al. | 399/44 |
| 5,697,028 A | | 12/1997 | Kobayashi et al. | 399/281 |
| 5,839,021 A | * | 11/1998 | Hayashi et al. | 399/236 X |
| 5,873,010 A | | 2/1999 | Enomoto et al. | 399/39 |
| 5,893,013 A | | 4/1999 | Kinoshita et al. | 399/284 |
| 6,026,265 A | | 2/2000 | Kinoshita et al. | 399/281 |
| 6,047,149 A | | 4/2000 | Nishimura et al. | 399/98 |

FOREIGN PATENT DOCUMENTS

| | | | |
|---|---|---|---|
| JP | 41-9476 | | 5/1941 |
| JP | 55-32060 | | 3/1980 |
| JP | 10-186768 | * | 7/1998 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus is capable of improving throughput, preventing deterioration of developer and preventing shortening of the life of a developing apparatus. In the image forming apparatus, an image holding member holds an electrostatic latent image and a developer carrier carries developer to a developing portion, and a speed ratio between the image holding member and the developer carrier varies according to an image ratio.

14 Claims, 8 Drawing Sheets

SPEED RATIO BETWEEN AN IMAGE HOLDING MEMBER AND A DEVELOPER CARRIER VARIES ACCORDING TO AN IMAGE RATIO

BACKGROUND OF THE INVENTION

1. Field of the Invention

The present invention relates to an electrophotographic type of image forming apparatus such as a printer and a copying machine.

2. Related Background Art

A jumping development method has been conventionally known, which uses a one-component developer for development. In the developing process, the one-component developer is made to fly up from a developer carrier to a required minute gap between the developer carrier and an image holding member facing each other. Such a method is disclosed in Japanese Patent Post-Exam Publication No. 41-9476. Another development technique is also known, which is to apply a high-frequency pulse bias (a frequency of 10 to 300 kHz) to the above-mentioned gap so that the developer will adhere to an image portion on the image holding member but not to a non-image portion (for example, refer to U.S. Pat. No. 3,866,574).

Still another development technique is known, which uses a two-component developer containing toner and carrier for development. In the developing process, the two-component is indiscriminately put into contact with both the image and nonimage portions on the image holding member while applying a low-frequency alternating electric field between the developer carrier and the image holding member, so that the developer will adhere substantially to the image portion along without adhesion to the nonimage portion (for example, refer to Japanese Patent Application Laid-Open No. 55-32060).

FIG. 4 schematically shows an example of an image forming apparatus provided with a conventional developing apparatus. In the developing apparatus of this example, a developing sleeve 120 as the developer carrier and an electrophotographic type of a drum-shaped photosensitive member or a photosensitive drum 1 as the image holding member are opposed to each other with a gap or developing area 113 therebetween so that an alternating electric field will be applied to the developing area 113.

To be more precise, the developing apparatus 110 is arranged to face the photosensitive drum 1 that rotates in the direction indicated by the arrow. In operation, well-known electrostatic latent image forming means 102 including a charger and exposing means form an electrostatic latent image on the photosensitive drum 1. The exposing means may be projection means for projecting an optical image of an original or an optical system that scans a laser beam modulated by a recorded image signal.

The developing apparatus 110 develops the electrostatic latent image formed on the photosensitive drum 1 to for a toner image. Well-known transferring means 103, including a transferring charger, transfer the toner image obtained to a transferring material such as paper. The transferring material with the toner image thereon is then separated from the photosensitive drum 1 and forwarded to fixing means 105 in which the toner image is fixed on the transferring material.

After the completion of the transferring process, toner particles remaining on the photosensitive drum 1 are removed by cleaning means 104 including a cleaning blade.

The developing apparatus 110 houses a nonconductive one-component developer 111 in a developing container 112. The one-component developer, that is, the toner 111 is carried by the developing sleeve 120 from the developing container 112 to the developing area 113 opposed to the photosensitive drum 1. The photosensitive drum 1 and the developing sleeve 120 are opposed to each other through the developing area 113 with a minute gap of 50 to 500 $\mu$m therebetween. In the developing area 113, the toner 111 is applied to the latent image on the photosensitive drum 1 to develop the same.

The toner 111 on the developing sleeve 120 carried to the developing area 113 is regulated by a blade 116 as a regulating member to form a toner layer 111*a* thinner in thickness than the gap between the blade 116 and the sleeve 120.

As discussed above, the developing apparatus 110 shown in FIG. 4 performs so-called non-contact development. In other words, since the toner layer 111*a* formed by the toner carried to the developing area 113 is thinner in thickness than the minute gap between the developing sleeve 120 and the photosensitive drum 1, the toner 111 flies up from the developing sleeve 120 through the air gap to the photosensitive drum 1. To improve developing efficiency in the developing process and hence form a high-density, vivid developed image with less fogging, a bias power supply 118 for constant-potential control applies a developing bias voltage containing an alternating component to the developing sleeve 120.

Such a developing bias makes it possible to alternately actuate an electric field provided in such a direction as to transfer the toner 111 from the developing sleeve 120 to the photosensitive drum 1 and an electric field provided in such a direction as to reversely transfer the toner 111 from the photosensitive drum 1 to the sleeve 120, resulting in an excellent developed image.

A magnetic pole S1 of a magnet roller 115 housed in the developing sleeve 120 forms a magnetic field in the developing area 113 to prevent fogging, making a line image vivid.

In the above-mentioned conventional image forming apparatus, however, the photosensitive drum 1 and the developing sleeve 120 rotate at a constant peripheral speed, for example, of 24 mm/s, regardless of whether the image to be developed has a relatively low image ratio such as a text or a relatively high image ratio. As a result, both gain an identical throughput, for example, of 4 ppm. Such an image forming apparatus may be inferior to another type, for example, an ink jet type, of image forming apparatus which varies throughput to an image having a relatively low image ratio such as characters may not be as good as that gained by another type of image forming apparatus.

SUMMARY OF THE INVENTION

It is an object of the present invention to provide an image forming apparatus capable of improving throughput, particularly to an image having a low image ratio.

It is another object of the present invention to provide an image forming apparatus capable of preventing deterioration of developer caused when an image is developed at a high image ratio, and preventing the life of a developing apparatus from being shortened due to the deterioration of the developer.

It is still another object of the present invention to provide an image forming apparatus comprising an image holding member for holding an electrostatic latent image, and a developer carrier for carrying developer to a developing portion, wherein a speed ratio between the image holding member and the developer carrier vary according to an image ratio.

It is yet another object of the present invention to provide an image forming apparatus comprising an image holding member for holding an electrostatic latent image, a developer carrier for carrying developer to a developing portion, and other developer carriers for respectively carrying developer of other colors to the developing portion, wherein a speed ratio between the image holding member and each of the developer carriers vary according to an image ratio for each color.

The above and other objects and features of the present invention will become more apparent by reading the following detailed description in connection with the accompanying drawings.

DESCRIPTION OF THE PREFERRED EMBODIMENTS

Image forming apparatuses according to the present invention will be described below in more detail with reference to the accompanying drawings.

[First Embodiment]

Figure 1:
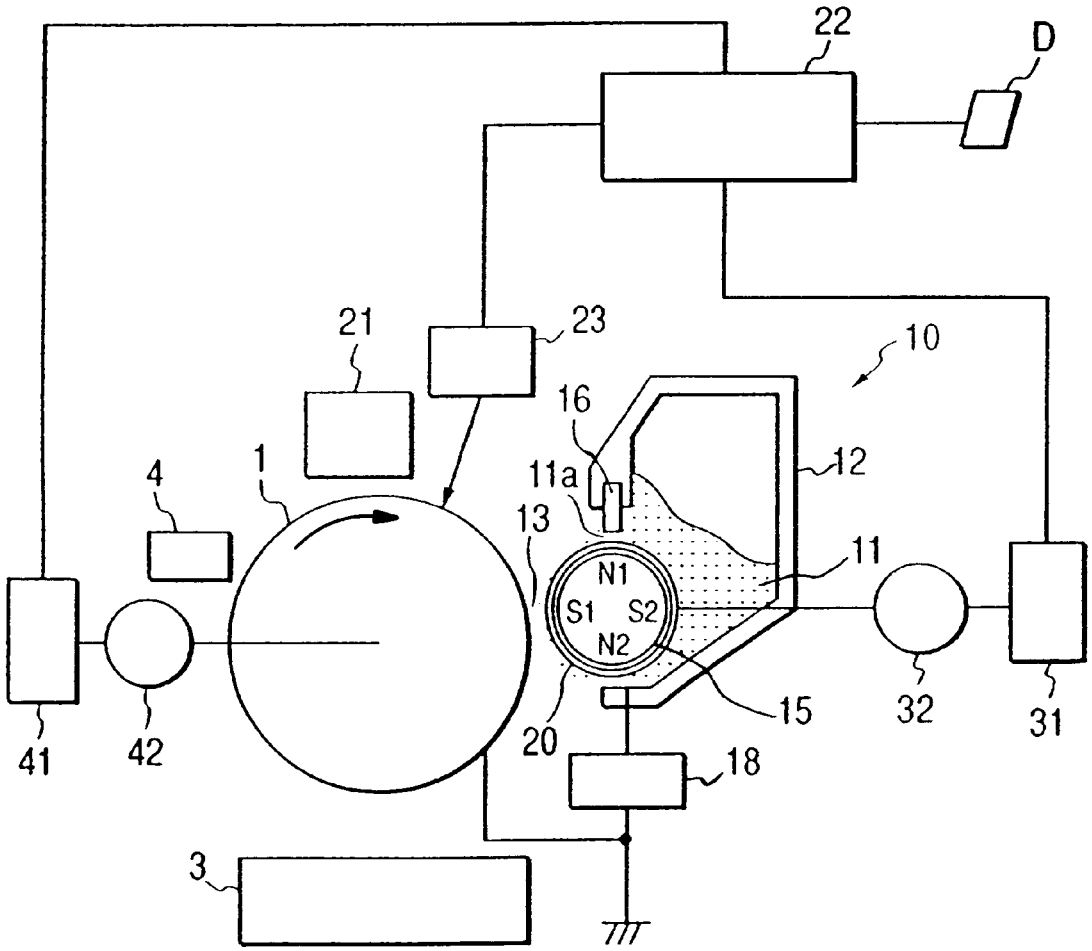
FIG. 1 is a schematic configuration diagram showing an image forming apparatus according to a first embodiment of the present invention.

Referring to FIG. 1, the following explains a first embodiment of the present invention.

In an image forming apparatus of this embodiment shown in FIG. 1, a developing apparatus 10 is arranged to face an electrophotographic type of a drum-shaped photosensitive member or photosensitive drum 1 as an image holding member that rotates in the direction indicated by the arrow.

In operation, charging means 21 such as a charging roller or corona charger uniformly charge the photosensitive drum 1. Then, an exposing apparatus 23 composed of optics scans a laser beam modulated by an image signal to cause an optical signal. The optical signal forms a latent image on the photosensitive drum 1.

The developing apparatus 10 develops the latent image formed on the photosensitive drum 1 to visualize the same. Well-known transferring means 3 including a transferring charger transfer the toner image (visual image) to a transferring material (recording medium) such as paper. The transferring material with the toner image thereon is then separated from the photosensitive drum 1 and forwarded to fixing means, not shown, in which the toner image is fixed on the transferring material.

After the completion of the transferring process, cleaning means 4 including a cleaning blade remove toner particles remaining on the photosensitive drum 1.

The developing apparatus 10 of the embodiment houses in a developing container 12 a nonconductive one-component developer 11 which does not contain carrier particles of magnetic toner. The developer 11 consists of nonconductive magnetic toner, and preferably a little silica fine powder is externally added to the developer 11. The silica fine powder is externally added to control triboelectric charge of the toner in order to increase image density and reduce image roughness. It is known that gas-phase process silica (dry silica) and/or wet process silica (wet silica) are externally added to the toner.

For example, developer prepared by externally adding dry silica having a strong negative-charging characteristic (such as one prepared by adding 10 pts.wt. of HDMS per 100 square meters of gas-phase process silica, which is then subjected to heat treatment) to negative polarity toner containing 60 pts.wt. of magnetite to styrene-acrylic is suitable for reversal development.

The one-component developer, that is, the toner 11 is carried by a nonmagnetic developing sleeve 20 as the developer carrier, made of aluminum, stainless steel or the like, which rotates in the direction indicated by the arrow. Then, it is transported from a developing container 12 to the developing area 13 opposed to the photosensitive drum 1. The photosensitive drum 1 and the developing sleeve 20 are opposed to each other through the developing area 13 with a minute gap of 50 to 500 $\mu$m therebetween. In the developing area 13, the toner 11 is applied to the latent image on the photosensitive drum 1 to develop the same.

The thickness of the toner 11 on the developing sleeve 20 carried to the developing area 13 is regulated by a regulating blade as a regulating member. The blade 16, made of a magnetic material such as iron, is opposed to a magnetic pole N1 of a magnet roller 15 through the developing sleeve 20. The magnetic roller 15 is magnetic field generating means arranged inside the developing sleeve 20. Therefore, lines of magnetic force from the magnetic pole N1 are concentrated on the blade 16 to form a strong magnetic curtain between the blade 16 and the developing sleeve 20. The magnetic curtain causes a toner layer 11*a* thinner in thickness than the gap between the blade 16 and the developing sleeve 20 to be formed on the developing sleeve 20.

It should be noted that the gap between the blade 16 and the developing sleeve 20 is so set that the toner layer 11*a* can be thinner in thickness than the minute gap between the sleeve 20 and the photosensitive drum 1, i.e., the space therebetween in the developing area 13.

As discussed above, the developing apparatus 10 of the embodiment performs so-called non-contact development. In other words, since the toner layer 11*a* formed by the toner carried to the developing area 13 is thinner in thickness than the minute gap between the developing sleeve 20 and the photosensitive drum 1, the toner 11 flies up from the developing sleeve 20 through the air gap to the photosensitive drum 1. To improve developing efficiency in the developing process and hence form a high-density, vivid developed image with less fogging, a bias power supply 18 for constant-potential control applies a developing bias voltage containing an alternating component to the developing sleeve 20.

As mentioned above, the developing bias is preferably made up by superimposing an alternating voltage on a direct voltage. It is desirable to set the frequency of the alternating voltage to about 1 to 2 kHz, and the peak-to-peak voltage (the different between the maximum value and the minimum value) to about 1.1 to 1.8 kV. With the waveform, a rectangular wave, a sine wave or a triangular wave may be used.

For example, when a latent image whose potential on a dark portion is −700 V and whose potential on a bright portion is −100 V is reversely developed with negatively charged toner, a developing bias voltage of a rectangular wave can be used as the developing bias. The developing bias voltage contains −500 V of direct component and an alternating component whose peak-to-peak voltage is 1.6 kV and frequency is 1.8 kHz.

Such a developing bias makes it possible to alternately actuate an electric field provided in such a direction as to transfer the toner 11 from the developing sleeve 20 to the photosensitive drum 1 and an electric field provided in such a direction as to reversely transfer the toner 11 from the photosensitive drum 1 to the sleeve 20, resulting in an excellent developed image.

It should be noted that the reversal development is a development method in which toner charged to the same pole as the latent image adheres to a potential area on the bright portion of the latent image to visualize the latent image. On the other hand, a development method in which toner charged to the pole opposite to that of the latent image adheres to a potential area on the dark portion of the latent image to visualize the latent image is called normal development.

The toner 11 is primarily charged to such a pole as to develop the latent image by friction with the developing sleeve 20. As an example, the toner 11 comprises nonconductive magnetic toner whose volume resistivity is about $10^{13}\Omega$. The toner consists of a binder resin whose main component is styrene-acrylic copolymer and to which 60 wt. % of magnetite and 1 wt. % of metallic complex salt of monoazo dye as a negative charge controlling agent are contained, with externally adding per toner weight 0.4 wt. % of fine powder subjected to hydrophobic treatment for increasing fluidity. Such toner is negatively charged by the above-mentioned friction with the developing sleeve 20.

A magnetic pole S1 of the magnet roller 15 forms a magnetic filed in the developing area 13 to prevent fogging, making a line image vivid. Magnetic poles N2 and S2 also shown here are magnetic poles that contribute to carrying of the toner 11.

The following describes characteristic portions of the present invention.

In the embodiment, when a latent image is formed on the photosensitive drum 1, an image input signal D is input to an image ratio calculating apparatus 22 in which an image ratio is calculated per page or for each of consecutive pages. In the commonest case, a ratio of an image area to the maximum image forming area is calculated as the image ratio, but calculation may be made to such an area as to secure the image, or other calculation methods may be adopted.

This embodiment assumes that the maximum image ratio is 100%. For example, the image ratio of a normal text document is about 5%. If the document contains a pictorial image in part, the image ratio is about 30 to 70%. Further, as an example, if a picture of stars in the night sky is printed out with a solidly black background, the image ratio can be 95% or more.

Information from the image ratio calculating apparatus 22 is led to a photosensitive drum controlling apparatus 41 by which the number of rotations of a photosensitive drum driving apparatus 42 for driving the photosensitive drum 1 is controlled according to the image ratio.

The developing sleeve 20 is driven by a developing sleeve driving apparatus 32. At this time, information from the image ratio calculating apparatus 22 is led to a developing sleeve driving control apparatus 31 by which the number of rotations of the developing sleeve driving apparatus 32 is controlled according to the image ratio.

In the embodiment, the peripheral speed of the photosensitive drum 1 can be continuously varied by the photosensitive drum driving apparatus 42 in a range of 24 to 94 mm/s.

Further, the transferring material can be fed and carried at the same speed as the peripheral speed of the photosensitive drum 1.

Since this embodiment presents no problem in fixing the toner in the range of 24 to 94 mm/s, no other variations occur according to the paper feeding and carrying speed. Of course, control temperature and welding force can be varied according to the image ratio so that the image forming apparatus can adapt to several kinds of transfer materials.

The peripheral speed of the developing sleeve 20 can also be varied by the developing sleeve driving apparatus 32 continuously in a range of 24 to 94 mm/s.

As mentioned above, the exposing apparatus 23 consists of optics for scanning a laser beam. The optics include a hexahedral polygon mirror. The rotational speed of the polygon mirror is also controlled in synchronism with the rotation of the photosensitive drum 1 so that the scanning density will not vary. Since the rotation of the polygon mirror cannot be instantaneously varied, it is of course desirable to use a self-scanned optical system such as an LED.

Figure 4:
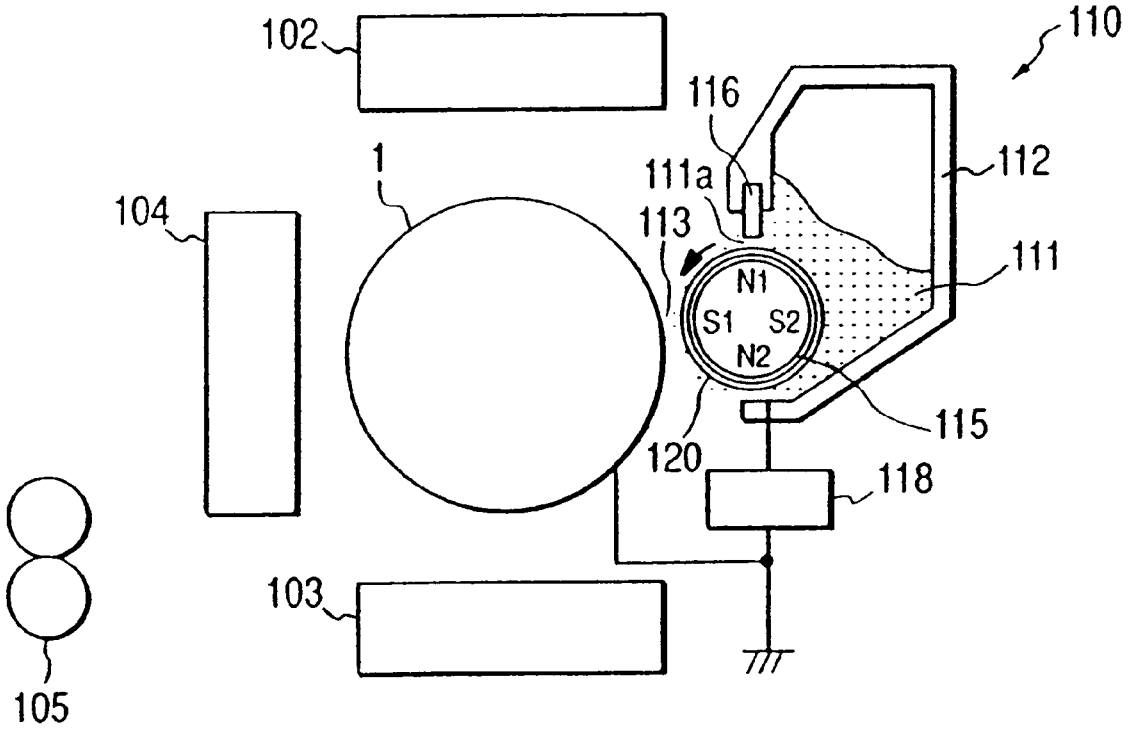
FIG. 4 PRIOR ART
FIG. 4 is a schematic configuration diagram showing an example of a conventional image forming apparatus.

The following table 1 shows examination results of throughput when the peripheral speeds of the developing sleeve and the photosensitive drum are varied in this embodiment according to the image ratio varied to 100%, 70% and 5%, respectively, together with those in an comparative example which results from the conventional example shown in FIG. 4. It should be noted that the image forming apparatus of the comparative example has the same specifications as those of the embodiment except for the peripheral speed of the photosensitive drum and the developing sleeve.

In the examination, it is assumed that the image ratio calculating apparatus 22 calculates an average image ratio for five pages of consecutive A-size document sheets.

TABLE 1

| Image ratio (Average value) | Comparative example: Peripheral speed of sleeve | Comparative example: Peripheral speed of photosensitive drum | Comparative example: Through-put | Embodiment: Peripheral speed of sleeve | Embodiment: Peripheral speed of photosensitive drum | Embodiment: Through-put |
|---|---|---|---|---|---|---|
| 100% | 24 mm/s | 24 mm/s | 4 ppm | 48 mm/s | 24 mm/s | 4 ppm |
| 70% | 24 mm/s | 24 mm/s | 4 ppm | 96 mm/s | 48 mm/s | 8 ppm |
| 5% | 24 mm/s | 24 mm/s | 4 ppm | 24 mm/s | 96 mm/s | 16 ppm |
| Remark | Constantly 4 ppm regardless of image ratio | | | 4 to 16 ppm depending on image ratio | | |

As shown in Table 1, the comparative example showed a constant throughput of 4 ppm regardless of the image ratio. On the other hand, the embodiment showed throughput from 4 ppm to 16 ppm, achieving a maximum throughput of 16 ppm.

Thus, according to the embodiment, the peripheral speeds of the developing sleeve and the photosensitive drum are varied according to the image ratio, that is, the speed ratio between both members is varied, thereby maximizing the throughput. Particularly, a high throughput can be achieved to a low image ratio.

Since a laser scanner is used in the embodiment, an average value of image ratios for one to five pages is used for control of each rotational speed, but the present invention is not limited thereto. It is easily thought of by those skilled in the art that the image ratio can be varied per page or weighted every page in this control process.

Further, if a self-scanned exposing apparatus such as an LED is used, more detailed control can be performed.

In the embodiment, a magnetic, one-component type of noncontact developing apparatus is used to describe the present invention. However, it goes without saying that other types of apparatuses, such as a two-component type of magnetic brush developing apparatus, a nonmagnetic, one-component type of contact developing apparatus, and a nonmagnetic, one-component type of noncontact developing apparatus, can be used to practice the present invention.

[Second Embodiment]

Figure 2:
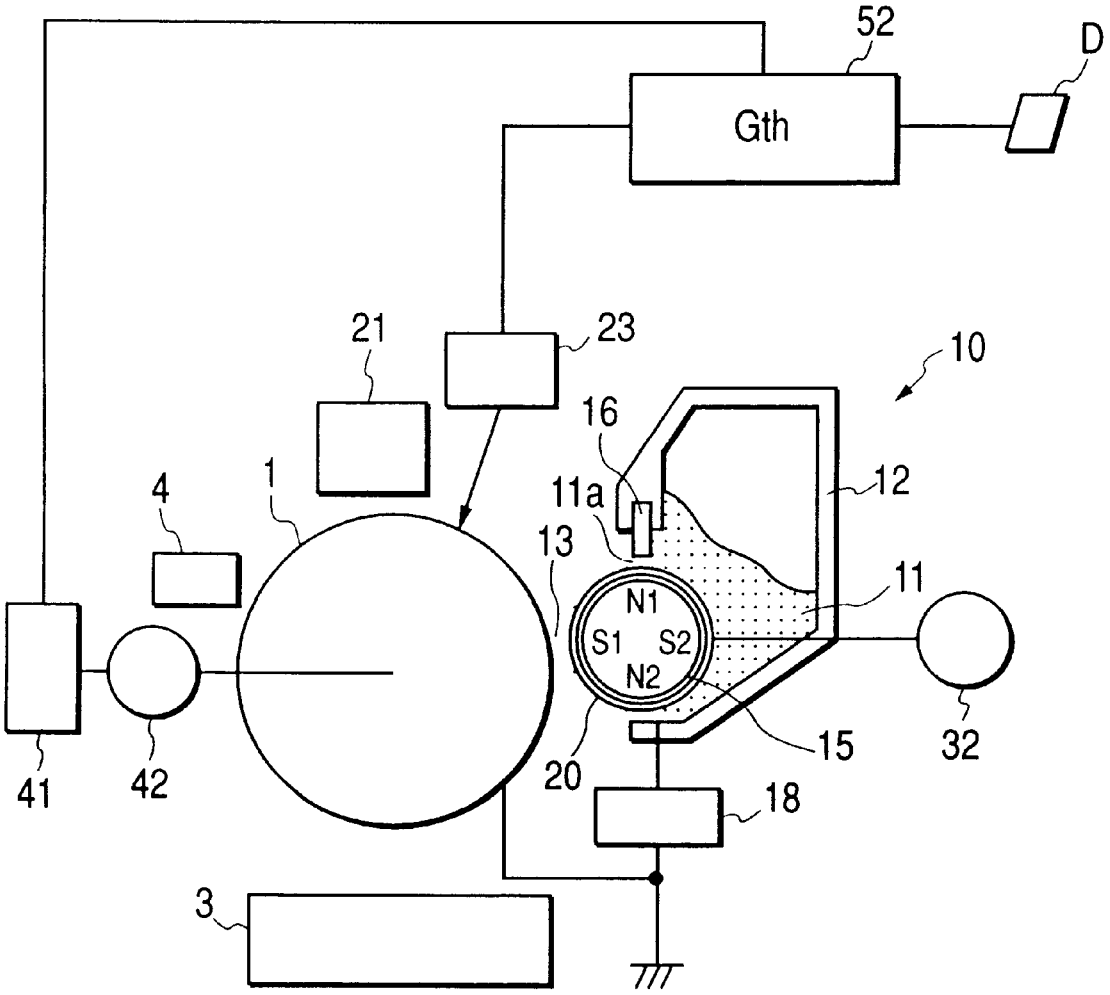
FIG. 2 is a schematic configuration diagram showing an image forming apparatus according to a second embodiment of the present invention.

Referring to FIG. 2, the following explains a second embodiment of the present invention.

An image forming apparatus according to this embodiment has substantially the same configuration as that in the first embodiment, but it features that an image ratio threshold Gth is set beforehand depending on the developing apparatus used. For image ratios equal to or less than the threshold Gth, the peripheral speed of the photosensitive drum 1 is increased to be higher than those of the photosensitive drum 1 provided at image ratios above the threshold Gth.

As in the first embodiment, it is assumed in this embodiment that an image ratio calculating apparatus 52 calculates an average image ratio for five pages of consecutive documents.

However, in the embodiment, only the peripheral speed of the photosensitive drum 1 is varied with keeping the peripheral speed of the developing sleeve 20 constant (24 mm/s). Further, the above-mentioned image ratio threshold Gth is set to 69%.

As in the first embodiment, the following Table 2 shows examination results of throughput when the image ratio is varied to 100%, 70% and 5% respectively in the embodiment and the conventional example chosen as a comparative example.

TABLE 2

| Image ratio (Average value) | Comparative example: Peripheral speed of sleeve | Comparative example: Peripheral speed of photosensitive drum | Comparative example: Through-put | Embodiment: Peripheral speed of sleeve | Embodiment: Peripheral speed of photosensitive drum | Embodiment: Through-put |
|---|---|---|---|---|---|---|
| 100% | 24 mm/s | 24 mm/s | 4 ppm | 24 mm/s | 24 mm/s | 4 ppm |
| 70% | 24 mm/s | 24 mm/s | 4 ppm | 24 mm/s | 24 mm/s | 4 ppm |
| 5% | 24 mm/s | 24 mm/s | 4 ppm | 24 mm/s | 96 mm/s | 16 ppm |
| Remark | Constantly 4 ppm regardless of image ratio | | | 4 to 16 ppm depending on image ratio | | |

In the embodiment, if the image ratio calculating apparatus 52 determines that the image ratio threshold is equal to or less than 69%, the photosensitive drum driving control apparatus 41 instructs the photosensitive drum driving apparatus 42 to increase the speed from 24 mm/s to 96 mm/s. Thus, the peripheral speed of the photosensitive drum 1 becomes 96 mm/s, and as a result, a throughput of 16 ppm can be achieved.

It should be noted that the above-mentioned threshold Gth is defined as the minimum image ratio enough for 70% to 100% full-page densities. The embodiment assumes a density of 1.1 as a standard value.

Further, if the image ratio is small, the image can be developed with a small amount of supply of the developer, and this is effective in speeding up image formation.

Although a developing apparatus as shown in FIG. 2 is used in the embodiment, the image ratio threshold Gth varies depending on the developing apparatus used. Therefore, acceleration ratio of the photosensitive drum 1 also varies, and the present invention is achieved in any case.

[Third Embodiment]

Figure 3:
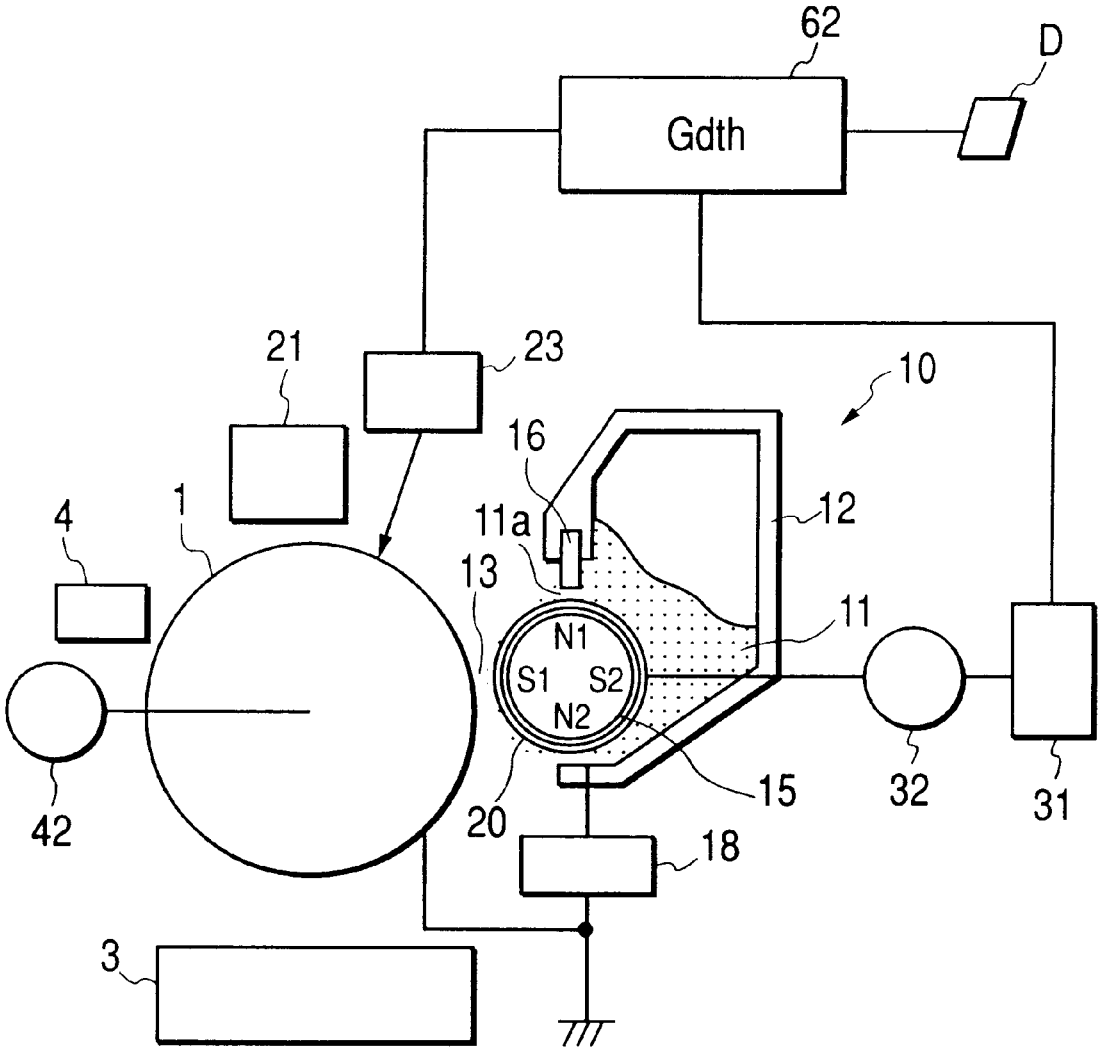
FIG. 3 is a schematic configuration diagram showing an image forming apparatus according to a third embodiment of the present invention.

Referring to FIG. 3, the following illustrates a third embodiment of the present invention.

This embodiment features that an image ratio threshold Gdth is set according to the developing apparatus used, and for image ratios equal to or less than the threshold Gdth, the peripheral speed of the developing sleeve is reduced to be lower than those of the developing sleeve provided at image ratios above the threshold Gdth.

As in the above-mentioned embodiments, it is assumed in this embodiment that an image ratio calculating apparatus 62 calculates an average image ratio for five pages of consecutive documents.

However, in this embodiment, the peripheral speed of the developing sleeve 20 is varied according to the image ratio threshold Gdth (69% in the embodiment) with keeping the peripheral speed of the photosensitive drum 1 constant (96 mm/s).

The following Table 3 shows examination results of throughput when the image ratio is varied to 100%, 70% and 5% respectively in the embodiment and the conventional example chosen as a comparative example.

TABLE 3

| | Comparative example | | | Embodiment | | |
|---|---|---|---|---|---|---|
| Image ratio (Average value) | Peripheral speed of sleeve | Peripheral speed of photosensitive drum | Life of developing unit | Peripheral speed of sleeve | Peripheral speed of photosensitive drum | Life of developing unit |
| 100% | 96 mm/s | 96 mm/s | 4000 pages | 96 mm/s | 96 mm/s | 4000 pages |
| 70% | 96 mm/s | 96 mm/s | 4000 pages | 96 mm/s | 96 mm/s | 4000 pages |
| 5% | 96 mm/s | 96 mm/s | 4000 pages | 24 mm/s | 96 mm/s | 16000 pages |
| Remark | Constant throughput of 16 ppm | | | Constant throughput of 16 ppm | | |

In this embodiment, the throughput is constantly kept at 16 ppm regardless of the image ratio (the average value), but when the image ratio is equal to or less than the threshold Gdth, the peripheral speed of the developing sleeve is reduced from 96 mm/s to 24 mm/s, thereby extending the life of the developing unit four times as long as that of the conventional.

In general, the life of the developing unit is proportional to the degree to which the developer is deteriorated. It is also well known to those skilled in the art that the degree of the deterioration depends on the peripheral speed of the developing sleeve 20. In the conventional, if the peripheral speed of the sleeve was designed to correspond to a high throughput of 16 ppm in order to maintain full-page solid image, deterioration of the developer would be speeded up, and hence the developing quality would be degraded even if a large amount of developer was still left in the developing container. In this embodiment to the contrary, the image ratio is checked as discussed above, so that the density can be maintained while keeping the optimum peripheral speed of the developing sleeve.

Although in this embodiment the image ratio threshold Gdth is set to 69%, the value should be determined from laboratory experiments. As shown in the second embodiment, a state in which a density of at least 1.1 can be maintained is considered desirable.

[Fourth Embodiment]

The following describes a fourth embodiment of the present invention.

This embodiment features that the developer 11*a* on the developing sleeve 20 of any of the first to third embodiments is regulated by the blade 16 to form a thin layer of the developer. The thin-layered developer is made to face the photosensitive drum 1 through a minute gap with the developing sleeve 20.

In the above-mentioned embodiments, the photosensitive drum or the developing sleeve is varied in peripheral speed according to the image ratio. It is easily thought of by those skilled in the art that the variations become difficult as the torque on the developing apparatus increases.

Further, if the photosensitive drum and the developing sleeve rotate in opposite directions as in a two-component developing apparatus, the rubbing torque will become larger.

The same thing takes place in a one-component type of contact developing apparatus.

In other words, as shown in this embodiment, the developer on the developing sleeve is regulated by the regulating means to form a thin layer of the developer which is then made to face the photosensitive drum through a minute gap with the developing sleeve. Thus, the photosensitive drum or the developing sleeve can be varied according to the image ratio.

As apparent from the above description, according to the image forming apparatus of the embodiment, the speed ratio between the image holding member and the developer carrier can be varied according to the image ratio, thereby achieving a high throughput according to the image ratio.

Further, since the image ratio threshold Gdth is so set that, when the image ratio is equal or less than the threshold Gdth, the peripheral speed of the developer carrier is reduced to be lower than that of the developer carrier provided at an image ratio larger than the threshold Gdth, deterioration of the developer caused when the image is developed at a high image ratio, and a reduction in the life of the developing apparatus accompanying the deterioration of the developer can be prevented. This makes them possible to obtain high image quality and improve cost-efficiency.

[Fifth Embodiment]

Figure 5:
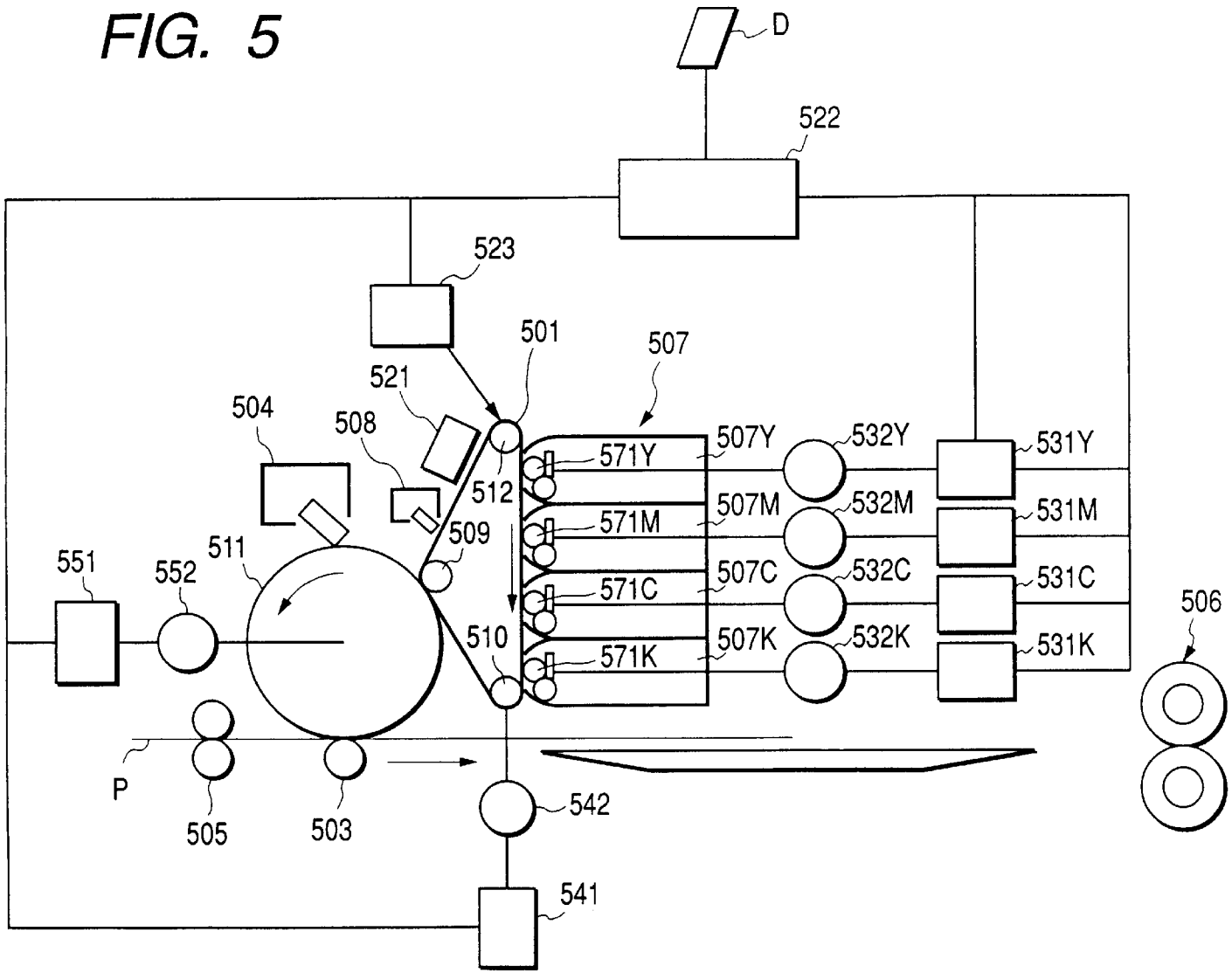
FIG. 5 is a schematic configuration diagram showing an image forming apparatus according to a fifth embodiment of the present invention.

Referring to FIG. 5, the following explains a fifth embodiment of the present invention.

At first, a configuration of a multicolor image forming apparatus of this embodiment will be described with reference to FIG. 5.

The multicolor image forming apparatus of this embodiment is provided with a photosensitive belt 501 as the image carrier in about the center. The photosensitive belt 501 is wound around a photosensitive belt driving roller 510, a backup roller 512, and a primary transferring roller 509. Provided around the photosensitive belt 501 are an exposing apparatus 523 composed of optics for scanning laser beams modulated by image signals for respective colors; charging means 521 such as a charging roller, a corona charger or the like; developing units 507Y, 507M, 507C and 507K as developing means for respective colors, namely, yellow Y, magenta M, cyan C and black K; a belt cleaner 508; an intermediate transferring drum 511 as an intermediate transferring member; an intermediate transferring drum cleaner 504; a secondary transferring roller 503; and so on.

In this embodiment, a non-contact type of nonmagnetic, one-component developing unit is used for the developing units 507Y, 507M, 507C and 507K for respective colors.

The multicolor image forming apparatus also includes a photosensitive belt driving apparatus 542 for driving the photosensitive belt driving roller 510, a photosensitive belt controlling apparatus 541 connected to the photosensitive belt driving apparatus 542 for control of the number of rotations of the photosensitive belt driving apparatus 542, an intermediate transferring drum driving apparatus 552 for driving the intermediate transferring drum 511, an intermediate transferring drum controlling apparatus 551 connected to the intermediate transferring drum driving apparatus 552 for control of the number of rotations of the intermediate transferring drum driving apparatus 552.

Further, in connection with the developing units 507Y, 507M, 507C and 507K, there are provided developing sleeve driving apparatuses 532Y, 532M, 532C and 532K for driving respective developing sleeves 571Y, 571M, 571C and 571K as developer carriers, which are provided to face the photosensitive belt 501; and developing sleeve controlling apparatuses 531Y, 531M, 531C and 531K connected to the respective developing sleeve driving apparatuses 532Y, 532M, 532C and 532K for control of the number of rotations of the respective developing sleeve driving apparatuses 532Y, 532M, 532C and 532K.

The photosensitive belt controlling apparatus 541, the intermediate transferring drum controlling apparatus 551, and the developing sleeve controlling apparatuses 531Y, 531M, 531C and 531K are connected to an image ratio calculating apparatus 522, respectively.

In the above-mentioned multicolor image forming apparatus, so-called image input signals D that contribute to formation of respective latent images are input to the image ratio calculating apparatus 522 so that image ratios are calculated for respective colors (Y, M, C and K) per page or every page in consecutive pages.

In general, a ratio of an image area to the maximum image forming area is calculated as the image ratio, but calculation may be made to such an area as to secure the image, or other calculation methods may be adopted. In this embodiment, the ratio to the maximum print-out area is calculated for each color.

The embodiment assumes that the maximum image ratio is 100%. For example, since the image ratio of a normal text document is about 5%, this embodiment assumes that black is 5% and each color is 0.5% in the interests of simplicity, or Y, M, C and K are all 0.5% for convenience sake.

If the document contains a pictorial image in part, the image ratio can be considered to range from about 30 to 70%. In this case, the ratio of each color is reduced.

The charging means 521 uniformly charges the photosensitive belt 501 driven to rotate in the direction indicated by the arrow. Then, an optical signal from the exposing apparatus 523 forms a latent image for each color on the photosensitive belt 501.

Information from the image ratio calculating apparatus 522 is led to the photosensitive belt controlling apparatus 541 by which the number of rotations of the photosensitive belt driving apparatus 542 is controlled according to the image ratio.

In this embodiment, the peripheral speed of the photosensitive belt 501 can be varied continuously in a range of 48 to 188 mm/s by means of the photosensitive belt driving apparatus 542.

The information for respective colors sent from the image ratio calculating apparatus 522 is led to the developing sleeve controlling apparatuses 531Y, 531M, 531C and 531K, respectively, so that the developing sleeve driving apparatuses 532Y, 532M, 532C and 532K can control the number of rotations of the developing sleeves 571Y, 571M, 571C and 571K according to the image ratios of respective colors. In this embodiment, the peripheral speeds of the developing sleeves 571Y, 571M, 571C and 571K of the developing units for respective colors can be varied in the range of 48 to 188 mm/s.

A latent image thus formed on the photosensitive belt 501, for example, a latent image Y is visualized with the developer (toner) in the yellow developing unit 507Y to form a toner image.

Information on the following colors is visualized with color developers M, C and K, and primarily transferred onto the intermediate transferring drum 511.

On the other hand, a transferring material P is fed and carried by a paper feeding roller 505 in correspondence to the peripheral speed of the intermediate transferring drum 511. The toner image formed on the intermediate transferring drum 511 is secondarily transferred to the transferring material P by means of the secondary transferring roller 503. The embodiment shows A4 size paper as an example of the transferring material P.

Then, the transferring material P is carried to a fixing apparatus 506 in which the developed image is fused on the transferring material P. Since this embodiment presents no problem in fixing the toner in the range of 48 to 188 mm/s, no other variations according to the paper feeding and carrying speed are not needed. Of course, control temperature and welding force can be varied according to the image ratio so that the image forming apparatus can adapt to several kinds of transfer materials.

In this embodiment, an optical system for scanning laser beams is used as the exposing apparatus 523. The rotational speed of the optical system is also controlled in synchronism with the rotation of the photosensitive belt 501 so that the scanning density will not vary. However, a self-scanned optical system such as an LED can also be used, and this makes it easy to maintain the exposure constant. In addition, unlike in a laser scanner, the rotation can be varied without delay, and this makes possible instantaneous control.

The following Table 4 shows throughputs when the peripheral speeds of the developing sleeves and the photosensitive belt are varied in this embodiment according to the image ratio (the average value). As discussed above, the image ratios of the colors Y, M and C are set equal to one another, i.e., Y=M=C, for convenience sake. Further, throughputs in the conventional example are also shown as a Comparative example.

TABLE 4

| Image ratio (Average value) | | Embodiment | | | | | Comparative example | | |
|---|---|---|---|---|---|---|---|---|---|
| | | Peripheral speed of sleeve | | Peripheral speed of photosensitive belt | | Through-put | Peripheral speed of | Peripheral speed of photosensitive | Through-put |
| Black | Color | Black | Color | Black | Color | (estimated) | sleeve | belt | (estimated) |
| 100% | 100% | 144 mm/s | 144 mm/s | 48 mm/s | 48 mm/s | 2 ppm | 72 mm/s | 48 mm/s | 2 ppm |
| 70% | 70% | 72 mm/s | 72 mm/s | 96 mm/s | 96 mm/s | 4 ppm | 72 mm/s | 48 mm/s | 2 ppm |
| 70% | 5% | 72 mm/s | 36 mm/s | 96 mm/s | 144 mm/s | 5 ppm | 72 mm/s | 48 mm/s | 2 ppm |

TABLE 4-continued

| Image ratio (Average value) | | Embodiment | | | | | Comparative example | | |
|---|---|---|---|---|---|---|---|---|---|
| | | Peripheral speed of sleeve | | Peripheral speed of photosensitive belt | | Through-put | Peripheral speed of | Peripheral speed of photosensitive | Through-put |
| Black | Color | Black | Color | Black | Color | (estimated) | sleeve | belt | (estimated) |
| 5% | 0% | 36 mm/s | 36 mm/s | 144 mm/s | 144 mm/s | 6 ppm | 72 mm/s | 48 mm/s | 2 ppm |
| 100% | 0% | 144 mm/s | — | 48 mm/s | — | 8 ppm | 72 mm/s | 48 mm/s | 8 ppm |
| 5% | 0% | 36 mm/s | — | 144 mm/s | — | 24 ppm | 72 mm/s | 48 mm/s | 8 ppm |
| Remark | | Throughput (estimated) can be optimized according to the ratio between black and color images: 2 to 6 ppm for full-color and 8 to 24 ppm for black | | | | | Constant throughput regardless of image ratio: 2 ppm for full-color and 8 ppm for black | | |

As shown in the Table 4, the comparative example showed constant throughputs of the image ratio, that is, 8 ppm for black and 2 ppm for full-color.

On the other hand, this embodiment showed throughputs that can be optimized according to the image ratios of respective colors, that is, 8 to 24 ppm for black and 2 to 6 ppm for full-color, maximizing the performance of the developing units.

As described above, the speed ratio between the developing sleeves and the photosensitive belt is varied according to the image ratio. It can be realized by those skilled in the art that the multicolor image forming apparatus of this embodiment is effective in maximizing throughput while preventing deterioration of the developer as much as possible.

Since a laser scanner is used in this embodiment, an average value of image ratios for one to five pages is used for control of each rotational speed, but the present invention is not limited thereto. It is thought of by those skilled in the art that the image ratio can easily be varied per page or weighted every page in this control process. Further, the control shown in the embodiment can be performed by use of an external signal.

Furthermore, if a self-scanned exposing apparatus such as an LED is used, more detailed control can be performed.

In this embodiment, a noncontact type of magnetic, one-component developing apparatus is used to described the present invention. However, it goes without saying that other types of apparatuses, such as a two-component type of magnetic brush developing apparatus and a contact type of one-component developing apparatus, can be used to practice the present invention as well.

[Sixth Embodiment]

Figure 6:
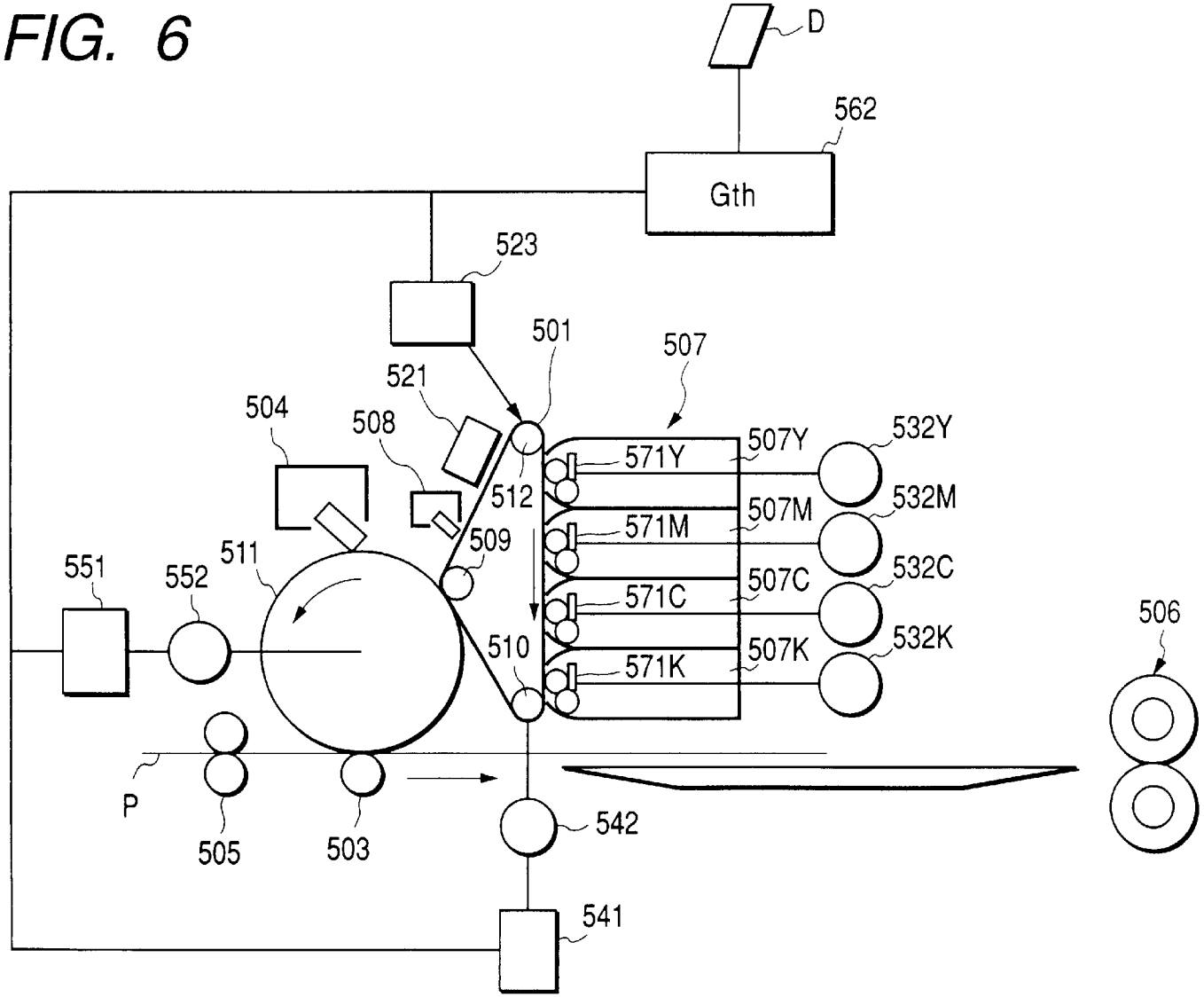
FIG. 6 is a schematic configuration diagram showing an image forming apparatus according to a sixth embodiment of the present invention.

Referring to FIG. 6, the following explains a sixth embodiment of the present invention.

A multicolor image forming apparatus of this embodiment shown in FIG. 6 has substantially the same configuration as that in the fifth embodiment, but it features that the developing sleeve controlling apparatuses 531Y, 531M, 531C and 531K do not need to be provided. It should be noted that members that operate the same way as the above-mentioned members are given the same reference numbers and description thereof is omitted.

This embodiment has image ratios Gth(Y), Gth(M), Gth (C) and Gth(K) determined according to the developing units 507Y, 507M, 507C and 507K for respective colors. For image ratios smaller than the above image ratios for respective colors, the speed of the photosensitive belt 501 is increased to be higher than that of the photosensitive belt provided in a case where at least one color has an image ratio larger than corresponding one of the image ratios Gth(Y), Gth(M), Gth(C) and Gth(K).

The image ratios Gth(Y), Gth(M), Gth(C) and Gth(K) are defined as the minimum image ratios for respective colors enough for 70% to 100% full-page densities. This embodiment assumes a density of 1.1 as a standard value.

This embodiment also assumes five pages of consecutive documents, where an image ratio calculating apparatus 562 calculates an average image ratio for each color.

The peripheral speed of the developing sleeve is kept constant (72 mm/s), and the image ratios Gth(Y), Gth(M), Gth(C) and Gth(K) for respective colors are all set to an identical value in the interests of simplicity, that is, they are set as Gth(Y)=Gth(M)=Gth(C)=Gth(K)=69%.

As mentioned above, in this embodiment, the peripheral speed of the photosensitive belt 501 is varied while keeping the peripheral speeds of the developing sleeves 571Y, 571M, 571C and 571K constant.

The following Table 5 shows throughputs when the peripheral speed of the photosensitive belt is varied in this embodiment according to the image ratio (the average value). Further, throughputs in the conventional example are also shown as a Comparative example.

TABLE 5

| Image ratio (Average value) | | Embodiment | | | | | Comparative example | | |
|---|---|---|---|---|---|---|---|---|---|
| | | Peripheral speed of sleeve | | Peripheral speed of photosensitive belt | | Through-put | Peripheral speed of | Peripheral speed of photosensitive | Through-put |
| Black | Color | Black | Color | Black | Color | (estimated) | sleeve | belt | (estimated) |
| 100% | 100% | 72 mm/s | 72 mm/s | 48 mm/s | 48 mm/s | 2 ppm | 72 mm/s | 48 mm/s | 2 ppm |
| 70% | 70% | 72 mm/s | 72 mm/s | 48 mm/s | 48 mm/s | 2 ppm | 72 mm/s | 48 mm/s | 2 ppm |
| 70% | 5% | 72 mm/s | 72 mm/s | 48 mm/s | 144 mm/s | 5 ppm | 72 mm/s | 48 mm/s | 2 ppm |

TABLE 5-continued

| Image ratio (Average value) | | Embodiment: Peripheral speed of sleeve | | Embodiment: Peripheral speed of photosensitive belt | | Embodiment: Through-put | Comparative example: Peripheral speed of | Comparative example: Peripheral speed of photosensitive | Comparative example: Through-put |
|---|---|---|---|---|---|---|---|---|---|
| Black | Color | Black | Color | Black | Color | (estimated) | sleeve | belt | (estimated) |
| 5% | 5% | 72 mm/s | 72 mm/s | 144 mm/s | 144 mm/s | 6 ppm | 72 mm/s | 48 mm/s | 2 ppm |
| 100% | 0% | 72 mm/s | — | 48 mm/s | — | 8 ppm | 72 mm/s | 48 mm/s | 8 ppm |
| 5% | 0% | 72 mm/s | — | 144 mm/s | — | 24 ppm | 72 mm/s | 48 mm/s | 8 ppm |
| Remark | | Throughput (estimated) can be optimized according to the ratio between black and color images: 2 to 6 ppm for full-color and 8 to 24 ppm for black | | | | | Constant throughput regardless of image ratio: 2 ppm for full-color and 8 ppm for black | | |

If the image ratio calculating apparatus 562 determines that the image ratio is equal to 69%, the photosensitive belt driving control apparatus 541 instructs the photosensitive belt driving apparatus 542 to increase the speed from 48 mm/s to 144 mm/s. Thus, as shown in the table 5, the following throughputs (estimated) can be obtained: 2 to 6 ppm for full-color and 8 to 24 ppm for black.

The definitions of Gth(Y), Gth(M), Gth(C) and Gth(K) indicate that the image ratios are minimum values enough to obtain 70% to 100% full-page densities for respective colors. This embodiment assumes a density of 1.1 as a standard value.

Further, if the image ratio is low, the image can be developed with a small amount of supply of the developer, and this is effective in accelerating throughput.

Although the same noncontact type of nonmagnetic one-component developing apparatus as that in the fifth embodiment is used in this embodiment, the image ratios Gth(Y), Gth(M), Gth(C) and Gth(K) vary depending on the developing apparatus used. Of course, variations in the image ratios cause differences in acceleration of the photosensitive belt from that in this embodiment, but the present invention is achieved even in such cases.

[Seventh Embodiment]

Figure 7:
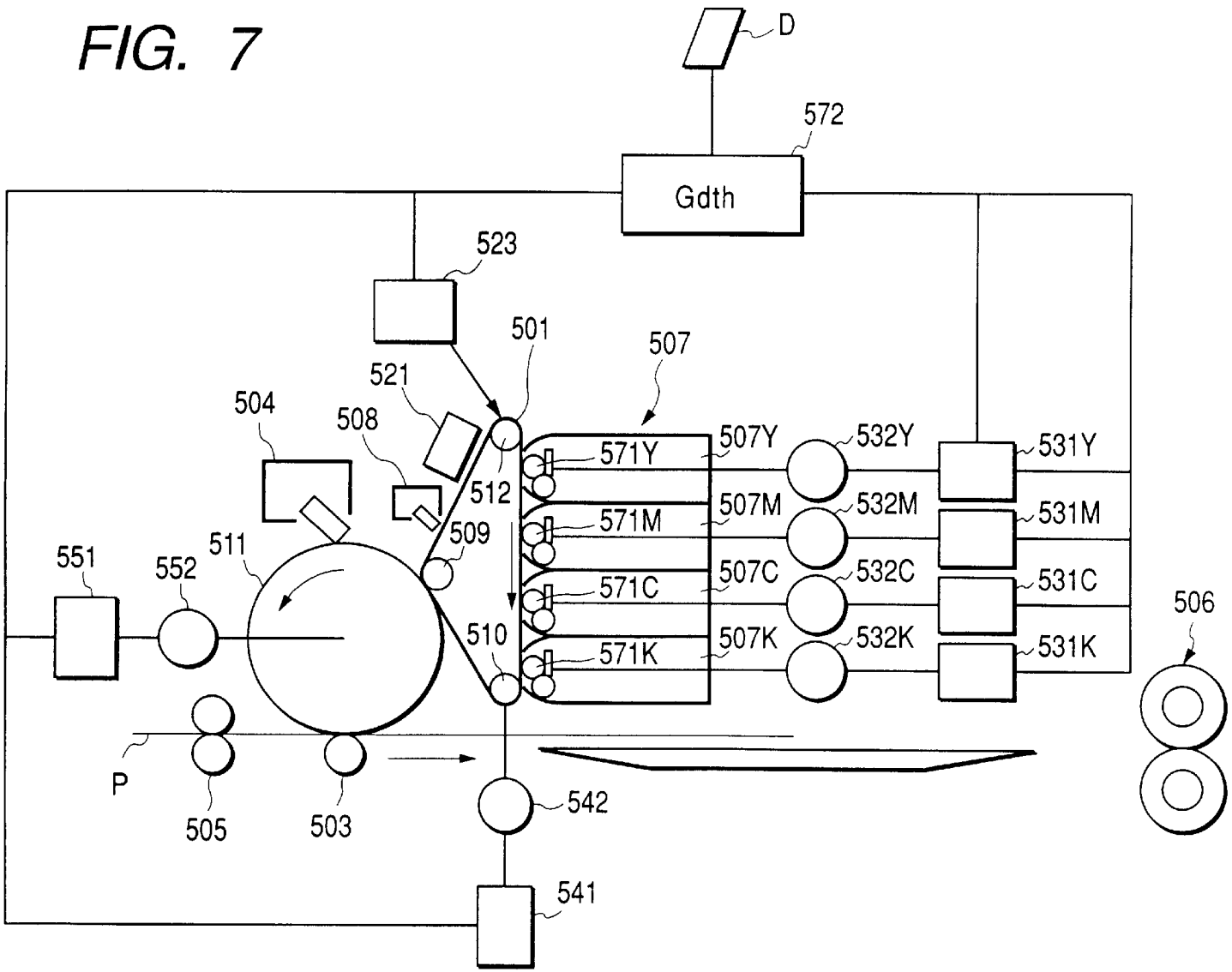
FIG. 7 is a schematic configuration diagram showing an image forming apparatus according to a seventh embodiment of the present invention.

Referring to FIG. 7, the following explains a seventh embodiment of the present invention.

A multicolor image forming apparatus of this embodiment shown in FIG. 7 has substantially the same configuration as that in the fifth embodiment, but it differs in the operation of the image ratio controlling apparatus. It should be noted that members that operate the same way as the above-mentioned members are given the same reference numbers and description thereof is omitted.

This embodiment has image ratios Gdth(Y), Gdth(M), Gdth(C) and Gdth(K) determined according to the developing units 507Y, 507M, 507C and 507K for respective colors. For image ratios larger than the above image ratios for respective colors, the speeds of the developing sleeves 571Y, 571M, 571C and 571K for respective colors are reduced to be lower than those of the developing sleeves 571Y, 571M, 571C and 571K provided at respective image ratios less than the image ratios Gdth(Y), Gdth(M), Gdth(C) and Gdth(K).

Although in this embodiment the image ratios Gdth(Y), Gdth(M), Gdth(C) and Gdth(K) are constantly set to 69%, the value varies depending on the developing units used, and it should be determined from laboratory experiments. As discussed in the sixth embodiment, a state in which a density of at least 1.1 can be maintained is considered desirable.

This embodiment also assumes five pages of consecutive documents, where an image ratio calculating apparatus 572 calculates an average image ratio for each color.

The peripheral speeds of the developing sleeves 571Y, 571M, 571C and 571K of the respective developing units are varied while keeping the speed of the photosensitive belt 501 constant.

The following Table 6 shows the life of the developing units in terms of the number of pages when the peripheral speeds of the developing sleeves 571Y, 571M, 571C and 571K are varied in the embodiment according to the image ratios (the average values). Further, cases in the conventional example are also shown as a Comparative example.

TABLE 6

| Image ratio (Average value) | | Embodiment: Peripheral speed of sleeve | | Embodiment: Peripheral speed of photosensitive belt | | Embodiment: Life of developing unit | | Comparative example: Peripheral speed of | Comparative example: Peripheral speed of photosensitive | Comparative example: Life of developing |
|---|---|---|---|---|---|---|---|---|---|---|
| Black | Color | Black | Color | Black | Color | Black | Color | sleeve | belt | unit |
| 100% | 100% | 144 mm/s | 144 mm/s | 144 mm/s | 144 mm/s | 3000 pages | 3000 pages | 144 mm/s | 144 mm/s | 3000 pages |
| 70% | 70% | 72 mm/s | 72 mm/s | 144 mm/s | 144 mm/s | 6000 pages | 6000 pages | 144 mm/s | 144 mm/s | 3000 pages |
| 70% | 5% | 72 mm/s | 36 mm/s | 144 mm/s | 144 mm/s | 6000 pages | 9000 pages | 144 mm/s | 144 mm/s | 3000 pages |
| 5% | 5% | 36 mm/s | 36 mm/s | 144 mm/s | 144 mm/s | 9000 pages | 9000 pages | 144 mm/s | 144 mm/s | 3000 pages |

TABLE 6-continued

| Image ratio (Average value) | | Embodiment | | | | | | Comparative example | | |
|---|---|---|---|---|---|---|---|---|---|---|
| | | Peripheral speed of sleeve | | Peripheral speed of photosensitive belt | | Life of developing unit | | Peripheral speed of | Peripheral speed of photosensitive | Life of developing |
| Black | Color | Black | Color | Black | Color | Black | Color | sleeve | belt | unit |
| 100% | 0% | 144 mm/s | — | 144 mm/s | — | 3000 pages | — | 144 mm/s | 144 mm/s | 3000 pages |
| 5% | 0% | 36 mm/s | — | 144 mm/s | — | 9000 pages | — | 144 mm/s | 144 mm/s | 3000 pages |
| Remark | Constant throughput (estimated) Regardless of ratio between black and color images: 6 ppm for full-color and 24 ppm for black | | | | | | | Constant throughput (estimated) Regardless of image ratio: 6 ppm for full-color and 24 ppm for black | | |

Although in this embodiment the throughputs are constantly kept, namely, 6 ppm for full-color and 24 ppm for black, the developing units are different in life from each other.

In general, the life of a developing unit is proportional to the degree to which the components or parts such as developer and a developing sleeve are deteriorated. It is also well known to those skilled in the art that the degree of the deterioration depends on the peripheral speed of the developing sleeve. In the conventional, if the peripheral speeds of the sleeves were designed to correspond to the maximum throughputs (6 ppm for full-color and 24 ppm for black in the embodiment) in order to maintain higher densities, deterioration of the developer would be speeded up, and hence the developing quality would be degraded even if a large amount of developer was still left.

In this embodiment to the contrary, the peripheral speeds of the developing sleeves are varied according to the image ratios, so that the densities can be maintained while maintaining the life of the developing units as long as possible.

Figure 8:
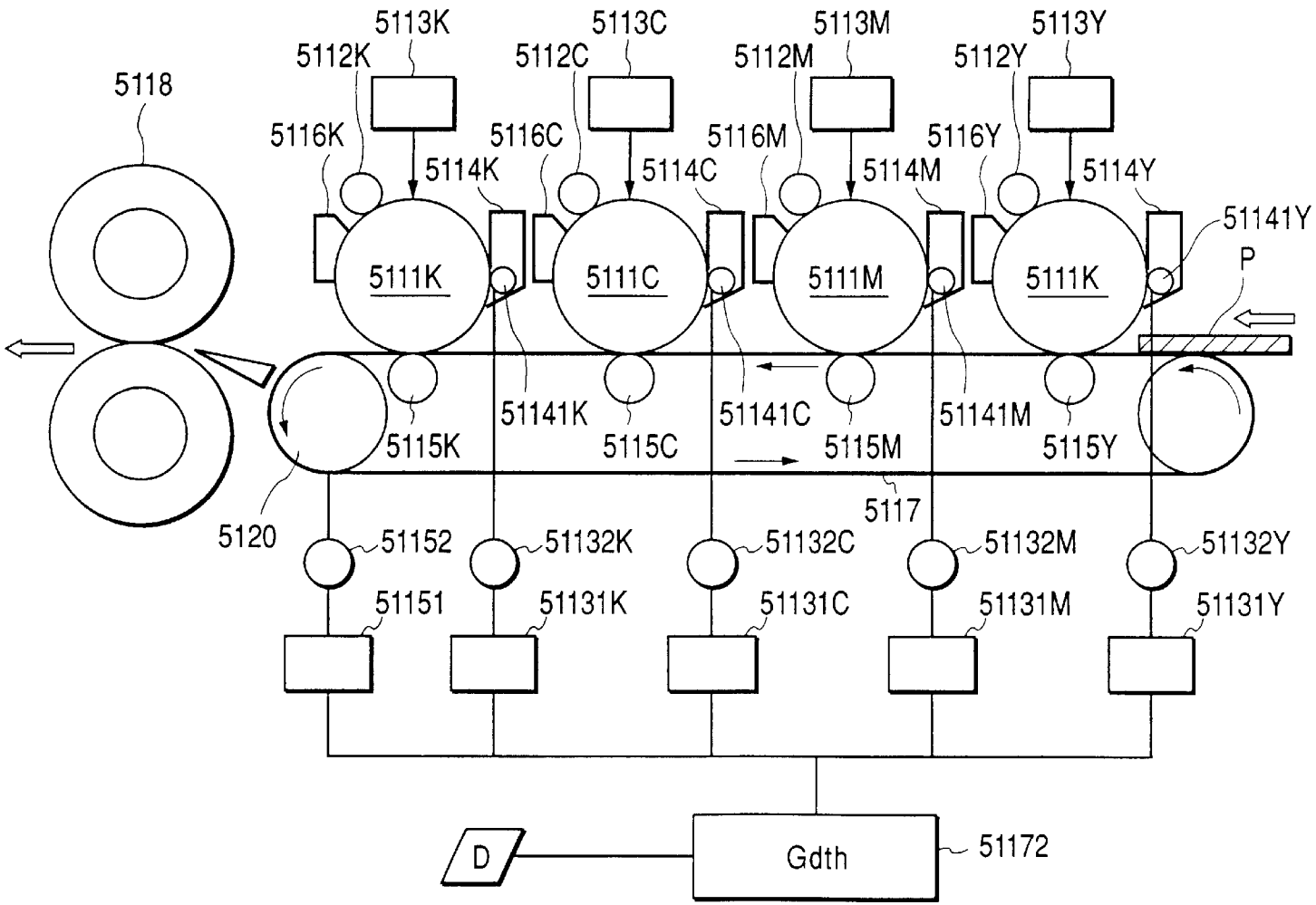
FIG. 8 is a schematic configuration diagram showing an image forming apparatus according to an eighth embodiment of the present invention.

As another form of this embodiment, an in-line type of image forming apparatus shown in FIG. 8 can also be cited.

As shown in FIG. 8, this embodiment has a configuration in which image forming stations Y, M, C and K for yellow Y, magenta M, cyan C and black K are disposed along a transferring belt 5117. In such a configuration, after charging apparatuses 5112Y, 5112M, 5112C and 5112K charge image carriers 5111Y, 5111M, 5111C and 5111K, exposing apparatuses 5113Y, 5113M, 5113C and 5113K form latent images corresponding to color information for respective colors. Then, developing apparatuses 5114Y, 5114M, 5114C and 5114K use developer to visualize the respective latent images as powder images.

After that, transferring apparatuses 5115Y, 5115M, 5115C and 5115K, arranged to face the respective image carriers 5111Y, 5111M, 5111C and 5111K, superimpose and transfer the powder images, formed on the image carriers 5111Y, 5111M, 5111C and 5111K, one upon another on the transferring material P absorbed on and carried by a transfer carrying belt 5117, and a fixing unit 5118 as fixing means fixes the unfixed powder images on the transferring material P.

After the completion of the transferring process, developer remaining on the respective image carriers 5111Y, 5111M, 5111C and 5111K is removed by cleaning apparatuses 5116Y, 5116M, 5116C and 5116K.

As shown in FIG. 8, the configuration also includes a carrying belt driving apparatus 51152 for driving a carrying belt driving roller 5120, and a carrying belt controlling apparatus 51151 connected to the carrying belt driving apparatus 51152 for control of the number of rotations of the carrying belt driving apparatus 51152.

Further, it includes developing sleeve driving apparatuses 51132Y, 51132M, 51132C and 51132K for driving respective developing sleeves 51141Y, 51141M, 51141C and 51141K, and developing sleeve controlling apparatuses 51131Y, 51131M, 51131C and 51131K connected to the respective developing sleeve driving apparatuses 51132Y, 51132M, 51132C and 51132K for control of the number of rotations of the developing sleeve driving apparatuses 51132Y, 51132M, 51132C and 51132K.

The carrying belt controlling apparatus 51152, and the developing sleeve controlling apparatuses 51131Y, 51131M, 51131C and 51131K are connected to an image ratio calculating apparatus 51172, respectively.

In the above-mentioned multicolor image forming apparatus, the peripheral speeds of the developing sleeves can also be varied according to the image ratios, so that the densities can be maintained while maintaining the life of the developing units as long as possible.

[Eighth Embodiment]

The following describes an eighth embodiment of the present invention.

This embodiment features that developer on each of developer carriers is so regulated that a thin layer of the developer will be formed. The thin-layered developer is then made to face the image holding member through a minute gap with the developer carrier.

In the above-mentioned embodiments, the image holding member or the developer carrier is varied in speed according to the image ratio. It is easily thought of by those skilled in the art that the variations become difficult as the torque on the developing apparatus increases.

Further, if the image holding member and the developer carriers rotate in opposite directions as in a two-component developing apparatus, the rubbing torque will become larger. The same thing also takes place in a one-component type of contact developing apparatus.

In other words, as in this embodiment, the developer on each of the developer carriers is regulated to form a thin layer of the developer which is then made to face the image holding member through a minute gap with the developer carrier. Thus, the image holding member or the developer carrier can be easily varied according to the image ratio.

As apparent from the above description, according to this embodiment, the speed ratio between the image holding member and the developer carriers can be varied according to plural image ratios for respective colors, thereby achieving high throughput to images having relatively low image ratios. Preferable throughput can also be achieved for images having relatively high image ratios, while high throughput can be achieved for images having relatively low image ratios in a relatively easy manner. Further, deterioration of the developer can be prevented, and the life of the developer can be extended. Furthermore, the torque-up can be reduced, so that a compact, cheap multicolor image forming apparatus can be provided.

What is claimed is:

1. An image forming apparatus comprising:

an image holding member for holding an electrostatic latent image; and a developer carrier for carrying developer to a developing portion, said developer carrier developing the electrostatic image with the developer; and recognition means for recognizing an information relating to an image ratio of the electrostatic latent image, wherein a speed ratio between said image holding member and said developer carrier is varied on the basis of said information recognized by said recognition means.

2. An apparatus according to claim 1, wherein a peripheral speed of said image holding member provided at an image ratio equal to or less than a predetermined threshold Gth is larger than that of said image holding member provided at an image ratio larger than the threshold Gth.

3. An apparatus according to claim 2, wherein a peripheral speed of said developer carrier is kept constant regardless of the image ratio.

4. An apparatus according to claim 1, wherein a peripheral speed of said developer carrier provided at an image ratio equal to or less than a predetermined threshold Gth is smaller than that of said developer carrier provided at an image ratio larger than the threshold Gth.

5. An apparatus according to claim 4, wherein a peripheral speed of said image holding member is kept constant regardless of the image ratio.

6. An apparatus according to claim 1, wherein said developer carrier is provided for each of colors of the developer.

7. An apparatus according to claim 1, wherein said image holding member and said developer carrier are provided for colors of the developer respectively.

8. An apparatus according to claim 1, wherein said recognition means calculates the image ratio on the basis of an image input signal corresponding to the electrostatic latent image.

9. An image forming apparatus comprising:

an image holding member for holding an electrostatic latent image;

a developer carrier for carrying developer to a developing portion; and other developer carriers for respectively carrying developer of other colors to the developing portion, each of said other developer carriers, respectively, developing the electrostatic latent image with the respective developer of other colors; and recognition means for recognizing an information concerning an image ratio of the electrostatic latent image, wherein a speed ratio between said image holding member and each of said developer carriers is varied on the basis of said information recognized by said recognition means.

10. An apparatus according to claim 9, wherein a peripheral speed of said image holding member provided at an image ratio equal to or less than a predetermined threshold Gth for each color is larger than that of said image holding member provided at an image ratio larger than the threshold Gth.

11. An apparatus according to claim 10, wherein a peripheral speed of each of said developer carriers is kept constant regardless of the image ratio.

12. An apparatus according to claim 9, wherein a peripheral speed of each of said developer carriers provided at an image ratio equal to or less than a predetermined threshold Gth for each color is smaller than that of said developer carrier provided at an image ratio larger than the threshold Gth for the color.

13. An apparatus according to claim 12, wherein a peripheral speed of said image holding member is kept constant regardless of the image ratio.

14. An apparatus according to claim 9, wherein said recognition means calculates the image ratio on the basis of an image input signal corresponding to the electrostatic latent image.

* * * * *

UNITED STATES PATENT AND TRADEMARK OFFICE

CERTIFICATE OF CORRECTION

PATENT NO. : 6,374,065 B1 
DATED : April 16, 2002
INVENTOR(S) : Katsuhiko Nishimura et al.

It is certified that error appears in the above-identified patent and that said Letters Patent is hereby corrected as shown below:

Column 2,
Line 36, "113-to" should read -- 113 to --; and
Line 49, "apparatus." should read -- apparatus. ¶Further, to maintain an amount of supply of developer to the developing sleeve as required to develop an image having a high image ratio such as a full-page picture, the peripheral speed of the developing sleeve has to accelerate, for example, up to 96 mm/s. In this case, the developer is deteriorated, that is, the developing quality is degraded to shorten the life of the developing apparatus. --.

Column 5,
Line 8, "different" should read -- difference --; and
Line 51, "filed" should read -- field --.

Column 13,
Line 7, "0%" should read -- 5% --.

Signed and Sealed this

Thirty-first Day of December, 2002

JAMES E. ROGAN
*Director of the United States Patent and Trademark Office*